US005142800A

United States Patent [19]

Hales et al.

[11] Patent Number: 5,142,800

[45] Date of Patent: Sep. 1, 1992

[54] SNOW GROOMER TOW FRAME ALIGNMENT DEVICE

[75] Inventors: Scott J. Hales; Terry L. Zollinger, both of Logan, Utah

[73] Assignee: Logan Manufacturing Company, Logan, Utah

[21] Appl. No.: 813,653

[22] Filed: Dec. 27, 1991

[51] Int. Cl.[5] ..... E01C 19/22

[52] U.S. Cl. ..... 37/220; 37/219; 37/DIG. 1

[58] Field of Search ..... 37/219, 220, 196, DIG. 1, 37/ DIG. 14, DIG. 20; 172/2, 4, 239, 260.5

[56] References Cited

U.S. PATENT DOCUMENTS 4,107,859 8/1978 Keith ..... 37/DIG. 1 X
4,341,027 7/1982 Rohner ..... 37/219 X
4,523,398 6/1985 Scheibel et al. ..... 37/219 X
4,542,600 9/1985 Hoehn, Jr. ..... 37/DIG. 1 X
4,560,303 12/1985 Haug et al. ..... 37/219 X
4,584,784 4/1986 Wolters et al. ..... 37/DIG. 1 X
4,651,451 3/1987 Beeley et al. ..... 37/219
4,788,783 12/1988 Bachler ..... 37/220
5,035,290 7/1991 Harms et al. ..... 37/DIG. 20 X
5,040,119 8/1991 Hardy et al. ..... 172/4 X

*Primary Examiner*—Randolph A. Reese
*Assistant Examiner*—J. Russell McBee
*Attorney, Agent, or Firm*—A. Ray Osburn

[57] ABSTRACT

A snow groomer tow frame alignment device which automatically centers the implement in line with the vehicle without the visual attention of the vehicle operator. The device utilizes a pair of inductive proximity switches and a corresponding metallic shield disposed around a frame stem pivot, switching in response to misalignment, initiating circuits directing a fluid control valve to actuate to provide fluid to alignment restoring cylinder and ram assemblies.

6 Claims, 5 Drawing Sheets

SNOW GROOMER TOW FRAME ALIGNMENT DEVICE

BACKGROUND OF THE INVENTION

1. Field

The field of the invention is towing systems for snow grooming devices propelled behind tracked vehicles, and more particularly, such devices having provisions for corrective adjustment of longitudinal alignment with the towing vehicle.

2. State of the Art

Initial attempts to secure snow grooming devices to towing vehicles probably employed simple vertical pivot mechanisms after the manner of highway trailer hitches. Shortcomings of this approach for use upon the steep terrain of ski slopes soon dictated the development and use of more sophisticated towing arrangements. Operating across hillsides, for example, caused the implement to swing sharply downhill about the connecting pivot. Similarly, when a path is groomed directly down a slope along the fall line, the towing vehicle often must restrain the free downward progress of the groomer, causing one side or the other of the implement to cock sidewise of the path. It is only with very rare directly uphill grooming paths that such towing problems would not occur.

Improvements in snow grooming equipment towing have been incorporated into a device known in the trade as an "articulated lift frame", which spans between the implement and the towing vehicle. The front end of this frame is pivotally joined to the towing vehicle along a laterally directed horizontal axis. A tow beam or bar is joined to the front end portion through a vertical pivot, and is rigidly secured at its rearmost end to the grooming implement. Hydraulic ram and cylinder assemblies, horizontally spaced apart, act between the frame front end and the tow beam to adjust alignment of the grooming implement.

Flow of hydraulic fluid to the cylinders is controlled by manually controlled electric valves, which are then manually commanded to the closed position after the alignment is corrected to the operator's visual satisfaction. The effectiveness of this arrangement is heavily dependent upon the skill and alertness of the operator, who also must control and direct the towing vehicle. The alignment is accomplished through backwardly viewing the device from the operator's seat during forward operation of the vehicle. Often, it is necessary to stop the vehicle for necessary alignment adjustment before continuation of a grooming path. Further, since the cylinders must be placed in float condition during sharp turns, adjustment is necessary at the beginning of each grooming pass.

The towing vehicle is provided also with a cylinder and ram connected to rotate the lift frame about the horizontal pivot axis to an upward, carrying position. The operator must align the frame during this process, to raise the implement into proper laterally horizontal carrying position.

Clearly, improvement in snow groomer towing apparatus is needed beyond the visually and manually adjusted state of the art towing frames presently available.

BRIEF SUMMARY OF THE INVENTION

With the foregoing in mind, the present invention eliminates or substantially alleviates the shortcomings and disadvantages in the prior art by providing a state of the art towing system for snow grooming devices including a tow frame having a foremost crossbar joined to a towing vehicle about a horizontal pivot axis, a frame stem joined thereto about a vertical pivot axis, and hydraulic cylinder means controlled by the vehicle operator for rotatably adjusting the alignment of the frame thereabout, and further providing electronic switching means responsive to stem misalignment, said switching means triggering automatic alignment-correcting action by the hydraulic cylinder means. Actuation of the switching means activates a circuit providing power to actuate a three position, four-way, electric fluid control valve to direct fluid to the cylinder ram assemblies to restore correct alignment. When the previously described articulated lift frame is utilized, alignment is restored by rotation, by the cylinders, of the elongate central stem of the lift beam about the forward vertical pivot. The beam is aligned, the electronic switch is deactivated, and the fluid control valve returns to its neutral, closed condition fluidically locking the cylinders with the frame stem in correctly aligned position.

The electronic switching means comprise a pair of forwardly facing, inductive, proximity switches installed spaced apart one above the other at the front end of the frame stem. Each switch has an oscillating circuit, and a well defined electromagnetic field extending forwardly from its front end.

Facing the front ends of the proximity switches is a metallic shield, called a "map", with a rearwardly extending arcuate portion concentric with the vertical pivot. The arcuate portion comprises a lowermost, downwardly opening notch associated with the lower proximity switch, and an uppermost, upwardly opening notch associated with the uppermost switch. The upper and lower notches overlap horizontally a small amount at the center line of the vehicle and run horizontally in opposite directions. When the lift frame stem, and therefore the implement, is in correct alignment, the notch overlap prevents interference by the map with the forwardly projecting electromagnetic fields of either the switches, so that neither actuates and the electric fluid control valve is not actuated. However, when misalignment occurs in either direction, the electromagnetic field forwardly of a corresponding switch is interrupted by intrusion of the solid portion of the metal map, eliminating or severely camping the oscillations, causing the switch to actuate. The valve remains in this alignment-correcting position until the cylinders complete moving the frame stem, and the implement being towed, back into alignment. The map then in this position no longer obstructs the electromagnetic field, and the proximity switch returns to original condition. The control valve then moves into neutral, locked, alignment position permitting no fluid to flow to or from either of the cylinders.

The vehicle operator is preferably provided with a switching control circuit allowing initiation of the automatic alignment sequence on command during operation.

When the previously-described articulated lift frame is utilized, a switch control circuit is provided which automatically activates alignment correction when the implement is raised upwardly into transport position. The raising of the implement is accomplished by separate hydraulic cylinder, and a separate associated electric fluid flow control valve. With the two valves, and the two circuits, simultaneously initiated, the misalignment is corrected during the lift of the implement to its carrying position.

It is therefore the principal object of the invention to provide an automatic towing alignment control system for snow grooming devices, not requiring visual attention to misalignment by the operator during alignment correction.

BRIEF DESCRIPTION OF THE DRAWINGS

In the drawings which represent the best modes presently contemplated for carrying out the invention.

DETAILED DESCRIPTION OF ILLUSTRATED EMBODIMENTS

Figure 1:
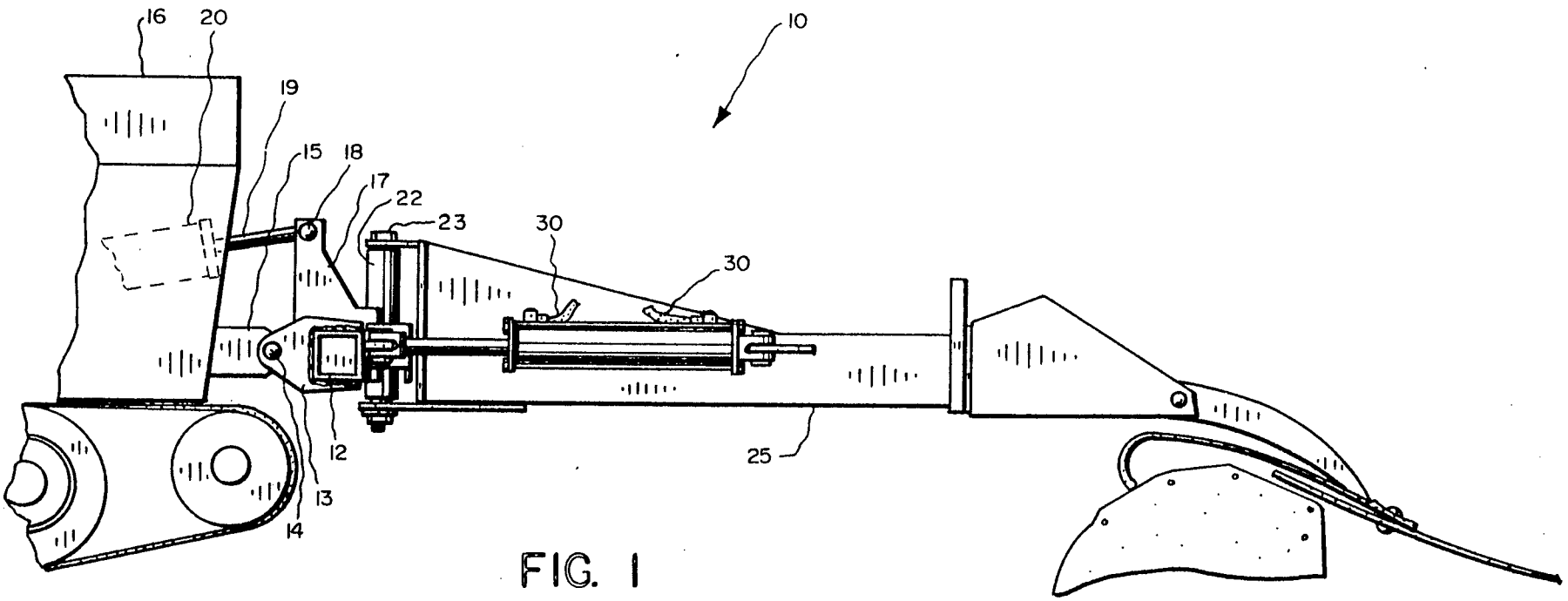
FIG. 1 is a side elevation view of a snow groomer tow frame alignment device in accordance with the invention, shown in use being towed by a vehicle and trailing a snow grooming tiller, drawn to a reduced scale, FIG. 2 a vertical, longitudinal, cross sectional view of a fragment of the frame alignment device of FIG. 1 also schematically indicating the vehicle mounted control valve and relay associated with the device, drawn to a larger scale than FIG. 1, FIG. 3 a top plan view of the frame alignment device of FIG. 1, drawn to approximately the scale of FIG. 2, FIG. 4 a perspective view of a fragment of the alignment device of FIG. 1, showing the conductive shield used to activate the proximity switches, drawn to a larger scale than FIG. 2, FIG. 5 a top plan view of the fragment of FIG. 4, drawn to approximately the same scale, FIG. 6 a front elevation view of the fragment of FIG. 4, drawn to approximately the same scale, FIG. 7 a front elevation view of the foremost end of the frame stem of the alignment device of FIG. 3, taken along line 7—7 thereof, showing the forward faces of the proximity switches, drawn to the approximate scale of FIG. 4, FIG. 8 a perspective view of one of the proximity switches utilized in the device of FIG. 1, drawn to approximately full scale, and FIG. 9 a schematic diagram showing the proximity switches, and associated relay and operator switch along with the electric fluid control valve.
Figure 2:
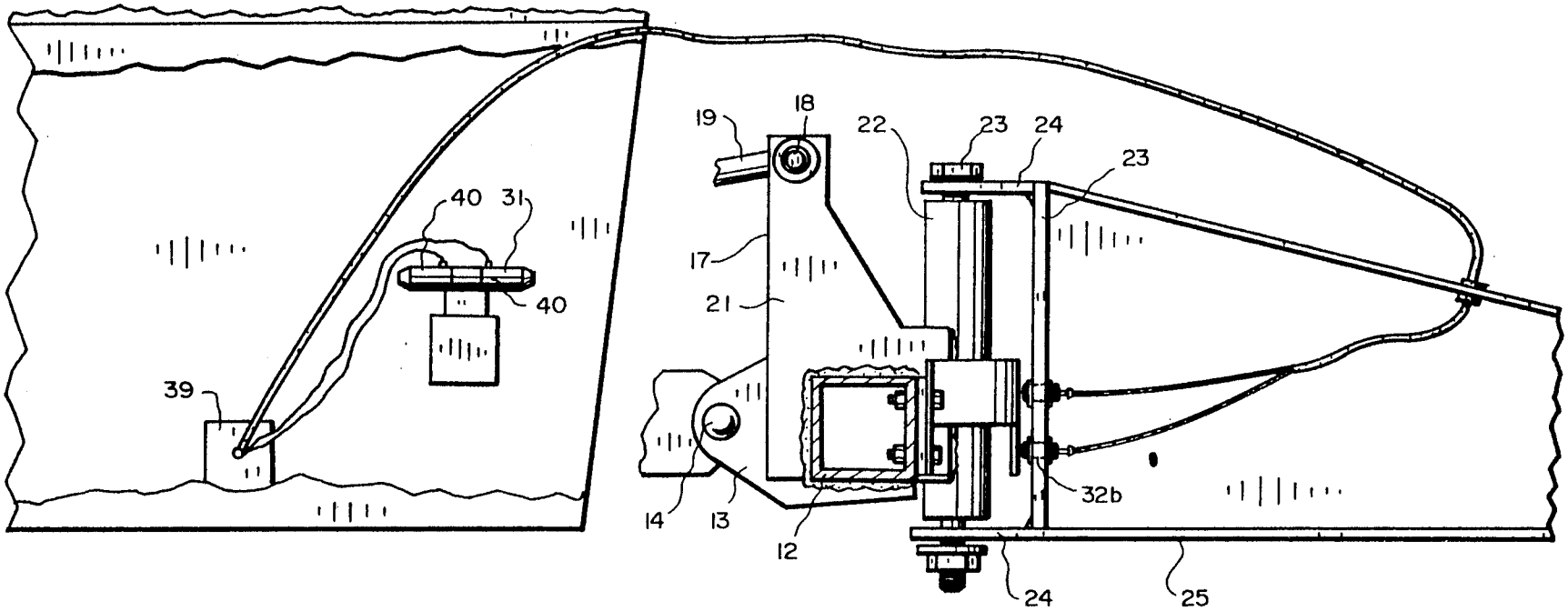
Figure 8:
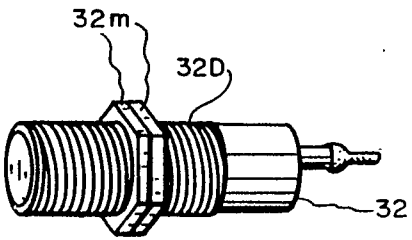
Figure 3:
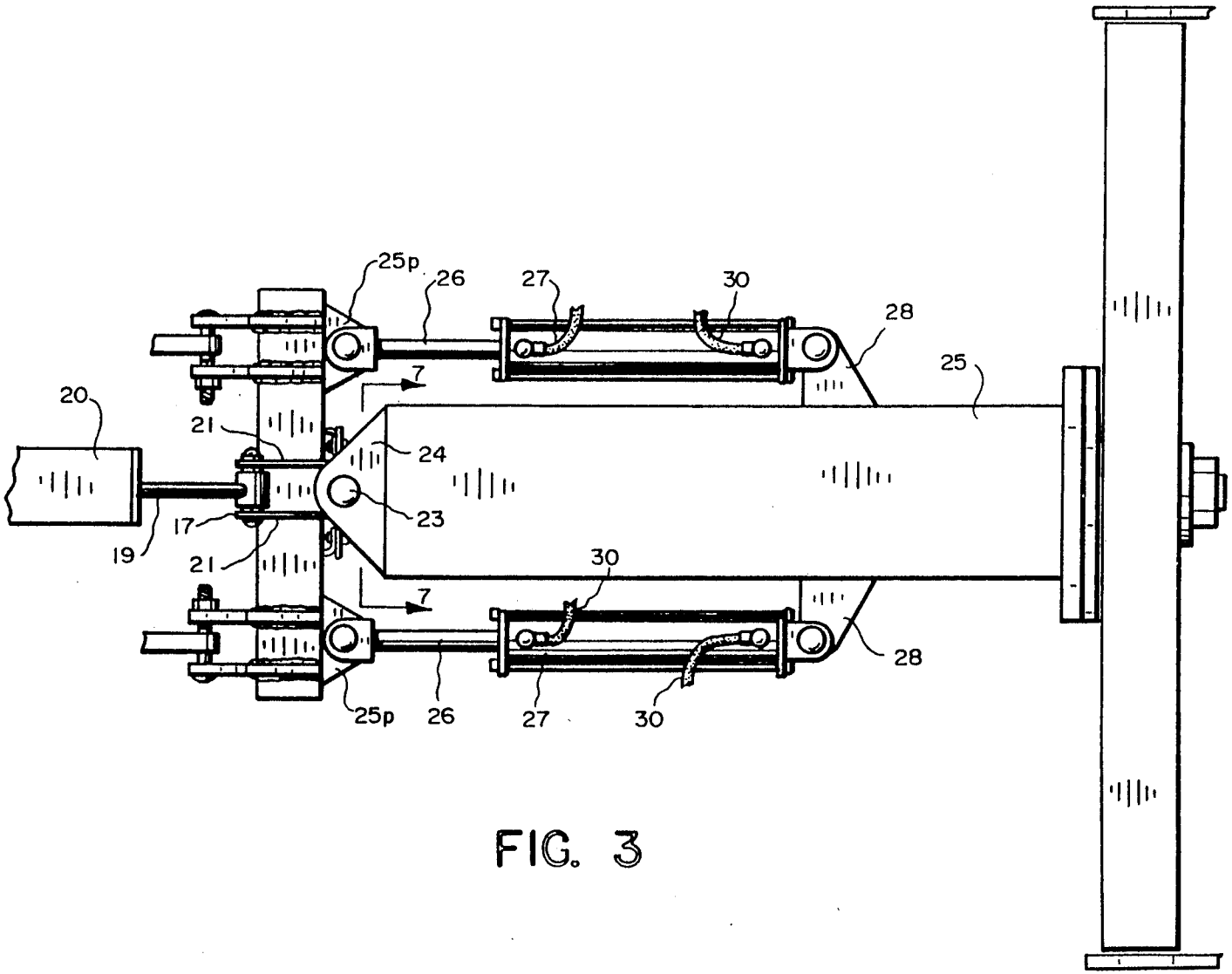
Figure 4:
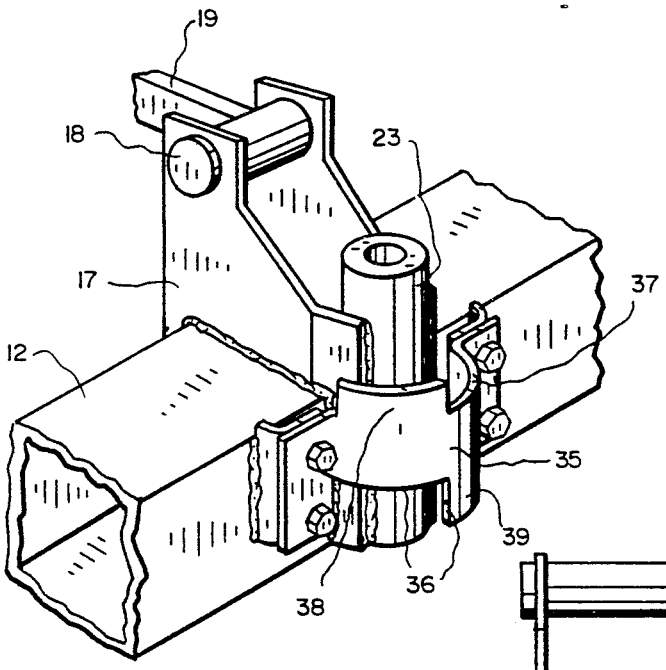
Figure 5:
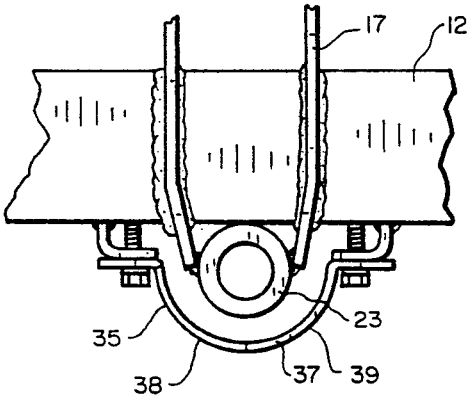
Figure 6:
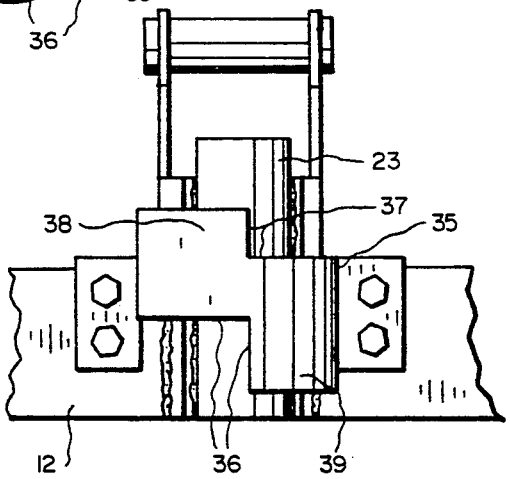
Figure 7:
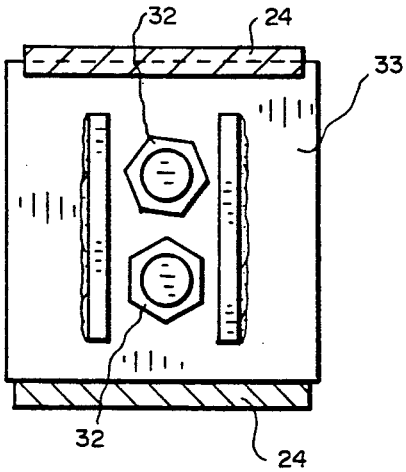

An articulated, automatic centering tow frame 10 is illustrated in FIG. 1 in conjunction with a snow grooming tiller 11, for example. Tow frame 10 comprises a forward crossbar 12 carrying a pair of forwardly extending pivot posts 13 joined by laterally aligned pins 14 to a pair of clevices 15 projecting rearwardly from the frame of a tracked towing vehicle 16. Front cross beam 12 also carries a welded clevice 17 providing a lateral horizontal pivot pin 18 upwardly of, and parallel to, pivot pins 14. Tow frame clevice 17 connects with a lift ram 19 of a hydraulic lift cylinder 20 mounted upon the frame of towing vehicle 16, all used to rotate the frame 10 upwardly about pins 14 for carrying. (FIGS. 1–3)

Side members 21 of clevices 17 are extended rearwardly to join with a vertical pivot sleeve 22 carrying a pivot pin 23. A pair of horizontal upper and lower pivot plates 24 extend forwardly from elongate body stem 25 of tow frame 10, secured by pin 23. A pair of pivot posts **25*p* on cross beam 12 provide for connection of rams 26 of a pair of hydraulic centering cylinders 27 secured at their rearmost ends to a pair of pivot posts 28 on opposite sides of tow frame stem 25. A system of hoses 30 supply high pressure hydraulic fluid to the double-acting cylinders 27, so that tow frame 10 is urged by rams 26 to rotate about vertical pivot 23 toward a position of correct alignment. As discussed in greater detail below, an electric hydraulic fluid control valve 31 mounted on vehicle 16 is used to direct fluid to the cylinders 27 for this alignment adjustment. (FIGS. 1 and 2**)

Various state of the art components may be used to manage a flow of high pressure fluid (provided by a vehicle mounted pump) to cause the cylinders 27 to bring the frame 10 into aligned position. In one satisfactory embodiment, a 3-position four-way valve 31 is used, having a contoured, spring centered, solenoid operated spool positioned within a housing to selectively connect passages returning the fluid back to a reservoir, directing it to the pair of hydraulically linked alignment cylinders 27 by way of a path through hoses 30 to cause rams 26 to move as necessary to restore correct alignment to frame 10. Control valve 31 may, for example, be Part No. 87-8050-103, of Rucker Fluid Power, Salt Lake City, Utah. When proper alignment is restored, valve 31 moves to by-pass the high pressure fluid to the reservoir, and to prevent any flow from or to either of the cylinders 27, immobilizing rams 26 and locking stem 25 of frame 10 in aligned position.

Manually operated controls and valving components, not shown, separate from the automatic alignment system, provide open fluid passages between the cylinders 27, so that frame 10 may swing freely about pivot pin 23 as necessary for negotiating sharp turns.

A pair of inductive proximity switches 32 are provided in a front bulkhead 33 of tow frame body stem 25, with active ends 34 facing toward an arcuate metallic shield ("map") 35, centered upon, and fixed to surround, the near side of, pivot sleeve 23. Switches 32 sense misalignment of stem 25, and actuate in response, initiating the above-described re-alignment process.

The inductive proximity switches 32 each include an oscillator circuit and a trigger circuit and an output. The oscillator creates a high-frequency electromagnetic field which appears at the active face of the switch. A well-defined zone is formed over this active face and is termed the active switching zone. When electrically conducting material enters this zone, the oscillations are damped to the point where very little or no oscillation is present. If the conducting material is removed from the active zone, the oscillator is free to oscillate again at full amplitude. These two states: oscillator oscillating (no object present in the active zone) and oscillator not oscillating (object present in the active zone) are then electronic evaluated.

Depending on the function of the switch (normally Open or Closed) the output is either switched or blocked.

Switches 32 may be selected from among commercially available models, such as type IIA from the EFECTOR Company, a subsidiary of IFM Electronic, Exton, Pa. This model has a threaded outside diameter 32D and a pair of positioning nuts **32*n*. A pair of bores 33*b* is provided through bulkhead 33, so that the switches 32 may be installed in adjusted position with respect to the map by use of the threads and the positioning nuts. Lowermost and uppermost, horizontally staggered, notches 36 and 37 respectively are provided on map 35. Departure from alignment of body 25 with front crossbar 12 (and vehicle 16) rotates one or the other of the proximity switches 32 to face upper or lower solid, unnotched, portions 38 or 39 of map 35. Proximity of the conducting metal of the map effectively destroys or severely damps the current oscillations. This change in current character causes the effected proximity switch 32 to actuate, and relay 39 to switch to a circuit providing current to the appropriate one of the solenoids 40, shifting the spool of valve 31 to direct high pressure fluid to flow through appropriate supply hoses 30 to cylinders 27. Rams 26 then actuate to rotate stem 25 about pin 23 toward a centered position of alignment. When stem 25 reaches its centered position, the switch 32 has moved away from the interfering metal of the map, and normal current oscillation resumes. Relay 39 thereupon interrupts the current to the solenoids 40, and the spring loaded spool returns to centered position within valve 31, hydraulically locking cylinders 27, with the implement 11** in aligned position. The flow of fluid is also diverted to the vehicle carried reservoir when the spool is in this centered position.

Controlling the automatic alignment process is a three way electrical switch 42 having "On", "Off", and "Momentary On" positions. (FIG. 9) By placing switch 42 into the "Off" position, the main power to the alignment system is terminated, rendering it inoperative. By briefly nudging switch 42 into the "Momentary On" position, relay 39 is commanded to attempt to complete the proximity switch circuits. Each of the switch circuits is normally open (blocking current flow). If either of the normally open proximity switches is closed due to misalignment and the resulting effect of the map as described above, the above-described centering sequence follows without further attention by the operator.

Figure 9:
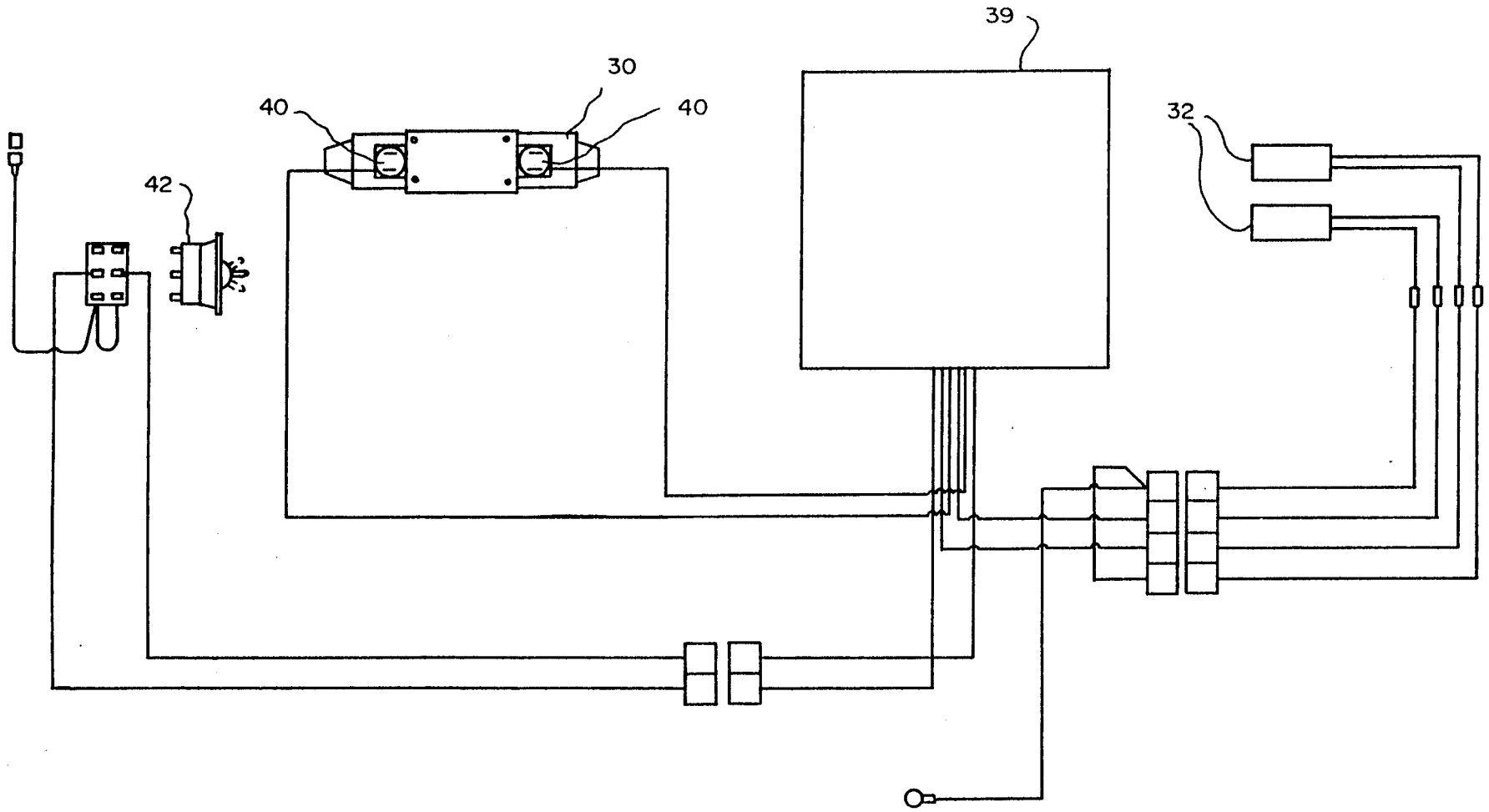

As previously mentioned, articulated, centering tow frame 10 may be lifted, along with attached implement 11, into an elevated carrying position, not shown, by directing high pressure hydraulic fluid to the cylinder 20. Ram 19 then acts upon pivot pin 18 of tow frame clevice 17, causing frame 10 to rotate upwardly about horizontal pivot pins 14. An additional electric fluid control valve 43 similar to valve 31, is used to supply cylinder 20. The operator actuates a lift lever 44 to complete an electrical circuit for actuating this lift control valve, and also actuating relay 39 to initiate the above-described frame centering process. Thus, frame 10 is simultaneously aligned while being lifted to carrying position. This relieves the operator of the burden of manually centering the frame before lift into carrying position. (FIG. 9)

We claim:

1. An automatic centering towing device for a snow grooming device propelled by a vehicle equipped to provide high pressure hydraulic fluid and direct current electrical power, said towing device comprising:

a frame including a foremost crossbar joined to the towing vehicle about a pivot having a horizontal axis lateral to the direction of travel of the vehicle, an elongate frame stem joined to the crossbar through a pivot having a vertical axis, said stem extending rearwardly therefrom to rigidly connect with a member to which the grooming device is attached, and double-acting hydraulic cylinder-and-ram means mounted to act between the crossbar and the frame stem to cause rotation therebetween about the vertical pivot axis to adjust the alignment of the grooming device with the vehicle;

conduit means supplying high pressure hydraulic fluid from the vehicle to operate the cylinder-and-ram means;

electronically operable valve means controlling a flow of said hydraulic fluid through the conduit means to supply the cylinder and ram means;

electronic switching means responsive to the state of alignment between the crossbar and stem;

electrical circuit means linking the fluid control valve means and the switching means, said circuit means including electronic means to automatically control the valve to direct operating fluid through the conduit means to the cylinder and ram means, to rotate the frame stem to restore alignment thereof with the vehicle.

2. The device of claim 1, wherein the electronic switching means comprises:

a pair of vertically aligned and spaced apart inductive proximity switches mounted on the frame stem facing and coplanar with the vertical pivot axis rearwardly thereof, said switches, when activated by direct current, producing current oscillations and a forwardly extending electromagnetic field, said field being dampable by intrusion of conducting material thereinto, the switches operating in response to camping of the electromagnetic field; and an arcuate, vertical metallic shield mounted on the foremost crossbar concentric with the vertical pivot axis, said shield having upper and lower portions each positioned to intrude into the electromagnetic field of the upper or the lower proximity switch upon rotation of the frame stem about the vertical pivot axis out of alignment with the vehicle, so that an appropriate one of the proximity switches is activated, triggering an appropriate circuit causing the electronic control valve to direct fluid appropriately to rotate the frame stem to restore alignment.

3. The device of claim 2, wherein the electronic fluid control valve comprises:

a contoured, spring centered, spool selectively positioned by solenoid action within a housing to selectively connect passages therethrough directing high pressure hydraulic fluid to return to a fluid reservoir carried by the vehicle while blocking all flow from or to the cylinder and ram means, or to flow through the conduit means by way of a selected one of two paths provided thereby to operate the cylinder-and-ram means to restore alignment by rotation of the frame stem clockwise or counter-clockwise.

4. The device of claim 3 wherein the cylinder and ram means comprises:

a pair of cylinder-and-ram assemblies pivotally mounted on opposite sides of the frame stem to act between the foremost crossbar and said stem.

5. The device of claim 4, wherein the electrical circuit means includes:

a three position manual switch selectively shutting off power to the electrical circuit means, providing power thereto, and initiating alignment restoration of the grooming device;

an electrical relay assembly, responsive to the manual switch, receiving output from the proximity switches, and commanding the fluid control valve to actuate to direct fluid for appropriate alignment restoring action of the cylinder and ram means, and to close when the proximity switch outputs indicate that alignment is restored.

6. The device of claim 5, further comprising:

a double acting cylinder and ram assembly mounted to act between the foremost crossbar and the vehicle, to lift the implement to carrying position by rotating said crossbar about the horizontal pivot;

conduit means supplying high pressure hydraulic fluid from the vehicle to operate the lift cylinder and ram assembly;

electronically operable lift valve means controlling a flow of said hydraulic fluid through the fluid supply conduit means of the lift cylinder and ram assembly; and electrical circuit means, including a lift lever actuated switch, providing direct current power to said lift valve means, and connecting with the electrical circuit means controlling the rotation of the frame stem to restore alignment thereof with the vehicle, so that the snow grooming device may be simultaneously raised into carrying position and restored to aligned position with the vehicle.

* * * * *